US006766666B2

(12) United States Patent
Okamoto

(10) Patent No.: US 6,766,666 B2
(45) Date of Patent: Jul. 27, 2004

(54) METHOD OF KNITTING NECK PORTION OF KNIT WEAR BY FLAT KNITTING MACHINE AND THE KNIT WEAR

(75) Inventor: Kazuyoshi Okamoto, Gose (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 59 days.

(21) Appl. No.: 10/276,324

(22) PCT Filed: May 23, 2001

(86) PCT No.: PCT/JP01/04357

§ 371 (c)(1),
(2), (4) Date: Nov. 25, 2002

(87) PCT Pub. No.: WO01/94672

PCT Pub. Date: Dec. 13, 2001

(65) Prior Publication Data

US 2004/0112094 A1 Jun. 17, 2004

(30) Foreign Application Priority Data

Jun. 2, 2000 (JP) ..... 2000-165262

(51) Int. Cl.[7] ..... D04B 7/30
(52) U.S. Cl. ..... 66/64; 66/176
(58) Field of Search ..... 66/64, 68–71, 66/60 R, 169 R, 170, 171, 172 R, 175, 176, 75.1

(56) References Cited

U.S. PATENT DOCUMENTS 5,417,088 A 5/1995 Nakai
5,956,975 A 9/1999 Kawashima
6,550,284 B2 * 4/2003 Okamoto ..... 66/69
6,658,899 B2 * 12/2003 Okamoto ..... 66/64
6,672,113 B2 * 1/2004 Okamoto ..... 66/76

FOREIGN PATENT DOCUMENTS

JP 10-204710 8/1998

* cited by examiner

*Primary Examiner*—Danny Worrell
(74) *Attorney, Agent, or Firm*—Rothwell, Figg, Ernst & Manbeck P.C.

(57) ABSTRACT

Seamless knitwear (1) having front and back bodies (2*a*, 2*b*) joined together at both widthwise ends thereof and formed into a tubular body from its rib hem toward its shoulder by using a flat knitting machine, the front body (2*a*) having a right and left front bodes (5*a*, 15*a*) into which the front body (2*a*) is forked from a front neckline forming starting point, wherein after the front neckline (10*a*) is knitted in a circular-arc cut form by a flechage knitting, the front body (2*a*) and the back body (2*b*) are joined together at the shoulder and then collars (8*a*, 8*b*) are knitted in a circular form in continuity with the knitting of the front neckline (10*a*) formed in the front body (2*a*) and a back neckline (10*b*) formed in the back body (2*b*), wherein the back neckline (10*b*) of the back body (2*b*) is formed to have substantially the same number of wale as the number of wale of the confronting front neckline (10*a*), and wherein the number of wale of the back neckline is decreased by transferring a stitch of the back neckline and overlapping it with an adjacent stitch in the same back neckline (10*b*).

3 Claims, 9 Drawing Sheets

METHOD OF KNITTING NECK PORTION OF KNIT WEAR BY FLAT KNITTING MACHINE AND THE KNIT WEAR

TECHNICAL FIELD

The present invention relates to a method of knitting a collar portion of knitwear by using a flat knitting machine, and to the knitwear knitted in that knitting method.

BACKGROUND ART

The applicant proposed a variety of knitting techniques using a flat knitting machine for knitting knitwear, such as a vest an a sweater, in a lot of applications including Japanese Laid-open (Unexamined) Patent Publications No. Hei 2(1990)-91254, No. Hei 2(1990)-229248, No. Hei 4(1992)-209855 and No. Hei 4(1992)-153346. In those proposed knitting techniques, a body and both sleeves of the knitwear are each knitted in the form of a tubular body up to the underarms and then are joined together at the underarms and knitted in the form of a single tubular body from the underarms to the shoulder, while the both sleeves are shifted toward the body to overlap the loops of the both sleeves with the loops of the body, whereby the single tubular body is gradually reduced in diameter. This knitting technique (hereinafter it is referred to as "seamless knit") can simplify or eliminate the sewing process after the knitting.

FIG. 9 shows a pattern paper (stitch alignment) of the body and sleeves of the sweater for the conventional seamless knit. Illustrated above is the pattern of a back body 102*b* and back sleeve portions 104*b*, 114*b* which will appear at the back side when wearing the sweater. Illustrated below is the pattern of a front body 102*a* and front sleeve portions 104*a*, 114*a* which will appear at the front side when wearing the sweater. It is to be noted that the terms "right" and "left" appearing in the members, such as the right front body 115*a* and the right sleeve 114, is intended to mean the right-hand part and the left-hand part when viewing from a wearer who wears the sweater.

In the sweater, the front body 102*a* and the front sleeves 104*a*, 114*a* are joined together at their respective underarms A, a and P, p, and the back body 102*b* and the back sleeves 104*b*, 114*b* are joined together at their respective underarms H, h and S, s. The line A-F-B of the front body 102*a* and the line P-Q of the sleeve 104*a* are joined together, and the line a-f-b of the front body 102*a* and the line p-q of the sleeve 114*a* are joined together. Likewise, the line H-I of the back body 102*b* and the line S-T of the sleeve 104*b* are joined together, and the line h-i of the back body 102*b* and the line s-t of the sleeve 114*b* are joined together. The line C-D-E-e-d-c represents a front neckline 110*a* having a circular-arc cut form, and the line J-j of the back body 102*b* represents a back neckline 10*b* confronting the front neckline and having the same number of wale (knitting width) between J-j. From E, e where the knitting of the neckline is started, the front neckline 110*a* is forked into a right front body 115*a* and a left front body 105*a* and knitted up to the shoulder. In this knitting, the so-called flechage knitting that the stitches around the neckline are sequentially put into operative states is repeatedly performed, whereby a circular-arc cut is formed at the front neckline 110*a*.

This circular-arc cut formed at the front neckline 110*a* is called a front drop. The like circular-arc cut which is called a back drop is sometimes formed in the back body 102*b*. The more the number of times the flechage knitting is repeated, the deeper the front drop formed becomes. The line B-C of the front body 102*a* and the line I-J of the back body 102*b* are joined together at the shoulder in the bind-off process. The line b-c of the front body 102*a* and the line i-j of the back body 102*b* are joined together in the same manner. After the forming of the neckline, front and back collars 108*a*, 108*b* are knitted around the neckline. After this manner, the knitting of the sweater 100 is ended.

In the knitwear knitted in the manner mentioned above, the front neckline 110*a* having a circular-arc cut form is identical in number of wale with the back neckline 110*b*, irrespective of a depth of the front drop. Due to this, the knitting width of the front collar 108*a* becomes shorter than a peripheral length of the front neckline 110*a*, thus causing the collar 108 to be stretched transversely and forcing the front drop to rise up. As a result of this, the front drop as expected cannot be obtained. In addition, since the collar cannot be given a sufficient knitting width, the neckline 110 cannot be given a sufficient dimension for one's head to smoothly pass through the neckline 110 when wearing. If the neckline 110 is modified in design so that the number of wale between C-c and between J-j of the front and back necklines 110*a*, 110*b* can be increased, respectively, the neckline 110 will be given a size for one's head to smoothly pass through, but on the other hand, it will be largely expanded laterally toward the shoulder to the extent corresponding to the increased number of wale, thus disadvantageously producing non-stylish knitwear.

The applicant previously proposed in Japanese Laid-open (Unexamined) Patent Publication No. Hei 4-21448 the knitting method wherein the neckline of the front body is increased in number of wale and also the front drop having a sufficient depth is formed in that neckline by using a flat knitting machine. This knitting method is a knitting method for the front body to be knitted as a single part of the knitwear. In this knitting method, the front body is knitted so that it can be forked from a starting point for the neckline into the right front body and the left front body, in the process of which widening stitches are formed around the neckline and also the stitches of the right front body and the stitches of the left front body are shifted to the outside, respectively. While this knitting is repeated, the front body is knitted up to the shoulder. As a result of the neckline being formed in this manner, the number of wale of the neckline is increased and, as a result of this, the collar knitted in continuity with the knitting of the neckline is widened and also since the collar is not stretched transversely, the front drop having a sufficient depth is formed in the neckline. When the front body thus knitted and other pieces or parts are sewn together to produce a sweater, the knitwear comes to be fancy and stylish and so comfortable to wear that when wearing, one's head can smoothly pass through the neckline.

However, the application of the knitting method of Japanese Laid-open (Unexamined) Patent Publication No. Hei 4(1992)-21448 previously cited to the knitwear to be knitted seamlessly is not easy when the knitwear having a large neckline width and the front drop formed in the neckline is formed. For example, when the knitwear is knitted in the form of a vest, consideration must be taken of not only the front body but also the relation with the back body which is integrally knitted in parallel with the front body to confront it. Further, in knitting a sweater, a cardigan and the like, since the sleeves are laid at each side of the bodies, further consideration must be taken, including the horizontal and vertical positions of those parts and the way of forming the neckline in the front body and of being integrally knitted with the other parts while shifting the neckline to the outside, thus requiring further complicated consideration and calculation. In addition, in the knitting method disclosed in the publication cited above, the neckline is formed by the loops being transferred and shifted to the outside, while the right front body and the left front body are subjected to the flechage knitting. As a result of this, the knitted fabric is not pulled down sufficiently, so that there is a limit to the number of times of the flechage knitting and there may be cases where the front drop having a sufficient depth cannot be obtained: It is the object of the present invention to provide a knitting method for knitting knitwear having a front drop having a sufficient depth, which is formed in a neckline of knitwear, such as a sweater, knitted seamlessly by using a flat knitting machine, and having a stylish collar in a relatively simple manner and to provide knitwear having such a stylish collar.

DISCLOSURE OF THE INVENTION

The present invention provides a method of knitting a collar of knitwear comprising a front body and a back body by using a flat knitting machine comprising at least a pair of first and second needle beds, at least either of which can be racked laterally to transfer stitches between the needles beds, wherein the knitwear is knitted in the condition that the front body is associated with the first needle bed and the back body is associated with the second needle bed, so that the front body and the back body are joined together at both knitting-widthwise ends to be knitted into a tubular body, and wherein the knitwear is knitted from its rib hem toward its shoulder, in the course of which from a front neckline forming starting point, the front body is forked into a right front body and a left front body and also the front body and the back body are knitted up to the shoulder while a flechage knitting that stitches around the neckline are sequentially removed from the knitting so as to be put into inoperative states is repeated a predetermined number of times to form the neckline in a circular-arc cut form, first, and, then, are joined together at the shoulder, followed by forming of a collar around the neckline, the method comprising the following steps:

a) that when the neckline of the front body is formed, a sufficient number of wale for forming a front drop having a sufficient depth is introduced in the front body, to form the neckline of the front body;

b) that after the neckline of the front body is formed, the front body and the back body are joined together at the shoulder in such a relation that a back neckline of the back body confronts the front neckline of the front body and has substantially the same number of wale as the number of wale of the confronting front neckline;

c) that the number of wale of the back neckline is decreased by transferring a stitch of the back neckline and overlapping it with an adjacent stitch in the same back neckline;

d) that during the knitting of the step c), at least one stitch at each side end of the front neckline is fed to the needle bed retraining the back neckline having the decreased number of wale, to minimize difference in the number of wale of the necklines retained between the front and back needle beds; and e) that the collar is knitted in continuity with the knitting of the necklines formed in the steps a) to d).

It is preferable that the knitting for decreasing the number of wale of the back neckline is performed in the order that one of right and left sides of the neckline is subjected to the same knitting, first, and, then, the other of the right and left sides of the neckline is subjected to the same knitting, and wherein the knitting method includes the step that when the number of wale of the back neckline is decreased at the one side of the neckline, the stitch at the side end of the front neckline is temporally fed to the needle bed retaining the back neckline on the other side of the neckline and then the same needle bed is racked, whereby the stitch at the side end of the front neckline and the stitch at the end on the other side of the back neckline are prevented from being spaced apart from each other to a large extent, so as to minimize a load put on those stitches.

Also, the present invention provides seamless knitwer having front and back bodies joined together at both widthwise ends thereof and formed into a tubular body from its rib hem toward its shoulder by using a flat knitting machine, the front body having a right front body and a left front body into which the front body is forked from a front neckline forming starting point, wherein after the front neckline is knitted in a circular-arc cut form by a flechage knitting, the front body and the back body are joined together at the shoulder and then collars are knitted in a circular form in continuity with the front neckline formed in the front body and the back neckline formed in the back body, wherein a back neckline of the back body is formed to have substantially the same number of wale as the number of wale of the confronting front neckline, and wherein the number of wale of the back neckline is decreased by transferring a stitch of the back neckline and overlapping it with an adjacent stitch in the same back neckline.

According to the knitting method of the present invention, when the neckline of the front body is formed, a sufficient number of wale for forming a front drop having a sufficient depth is introduced in the front body, to form the neckline of the front neckline and also a back neckline of the back body is formed to have substantially the same number of wale as the number of wale of the confronting front neckline. The number of wale of the back neckline is in excess of an actually required number of wale. After that, the number of wale of the back neckline is decreased by overlapping adjacent stitches of the back neckline with each other to reduce the diameter of the opening of the neckline. In parallel with this, stitches at each side end of the front neckline are sequentially fed to the needle bed retraining the back neckline, to minimize difference in the number of wale of the necklines retained between the front and back needle beds. As a result of the number of wale of the back neckline being decreased, followed by the knitting of the collar, the front collar knitted in continuity with the front neckline is prevented from being stretched transversely to an extent corresponding to the decreased width of the back neckline. This can produce the neckline with the front drop having a sufficient depth and thus can produce a seamless knit which is stylish and so comfortable to wear that when wearing, one's head can smoothly pass through the neckline.

In the knitting for decreasing the number of wale of the back neckline, one of right and left sides of the neckline is subjected to the same knitting, first, and, then, the other of the right and left sides of the neckline is subjected to the same knitting. When the number of wale of the back neckline is decreased at the one side of the back neckline, the stitch at the side end of the front neckline is temporally fed to the other side of the back neckline retained on the needle bed. By virtue of this, even when a large number of wale of the back neckline is wanted to be decreased, the racking of the needle bed can allow the stitch at the side end of the front neckline and the stitch at the end on the other side of the back neckline to be prevented from being spaced apart from each other to a large extent, so as to prevent occurrence of yarn breakage. In addition, this knitting for decreasing the number of wale of the neckline is provided as a separate process after the knitting for joining together the front and back bodies. This can make it possible to ignore the issue that consideration must be taken of the horizontal and vertical positions of the parts of the fabric, such as the bodies and the sleeves, on the needle beds, as well as of the way how those parts are integrally knitted, while forming the neckline in the front body. In addition, this can provide the advantage of producing the knitting program for a variety of knitwear in a relatively easy and simple way, regardless of types of knitwear, a vest or a sweater, or types of sleeves, a raglan sleeve type or set-in type. Also, even when the flat knitting machine used owns a number of previously produced knitting programs, since the knitting program mentioned above can be simply added to those existing programs, modifications can be made easily.

Also, in the knitwear of the present invention, the back neckline is formed to have substantially the same number of wale as the number of wale of the confronting front neckline, and the number of wale of the back neckline is decreased by overlapping the adjacent stitches with each other. Then, the collars are knitted in continuity with this knitting of the necklines. As a result of this, the front collar knitted in continuity with the front neckline is prevented from being stretched transversely to an extent corresponding to the decreased width of the back neckline. This can produce the neckline with the front drop having a sufficient depth and thus can produce a seamless knit having a stylish collar.

BEST MODE FOR CARRYING OUT THE INVENTION

In the following, a certain preferred embodiment of the present invention will be described in detail with reference to the accompanying drawings.

In the illustrated embodiment, a so-called four-bed flat knitting machine is used which has a pair of front and back lower needle beds, each having a number of knitting needles arranged in line thereon and confronting each other in front and back across a needle bed gap and another pair of front and back upper needle beds located over the pair of lower needle beds, though not shown. In the flat knitting machine, the front and back needle beds are structured so that they can be racked laterally to transfer a loop between the front and back needle beds. When knitting by using the four-bed flat knitting machine, a front knitted part of the fabric of the knitwear is knitted with needles of the front lower needle bed (hereinafter it is referred to as "FD") and the needles of the back upper needle bed (hereinafter it is referred to as "BU") and a back knitted part of the fabric is knitted with needles of the back lower needle bed (hereinafter it is referred to as "BD") and the needles of the front upper needle bed (hereinafter it is referred to as "FU"). In this embodiment, when the front knitted part of the fabric is knitted, the back part of the fabric is associated with (retained on) the back lower needle bed, while on the other hand, when the back knitted part of the fabric is knitted, the front part of the fabric is associated with (retained on) the front lower needle bed, whereby the knitwear is knitted seamlessly.

Figure 1:
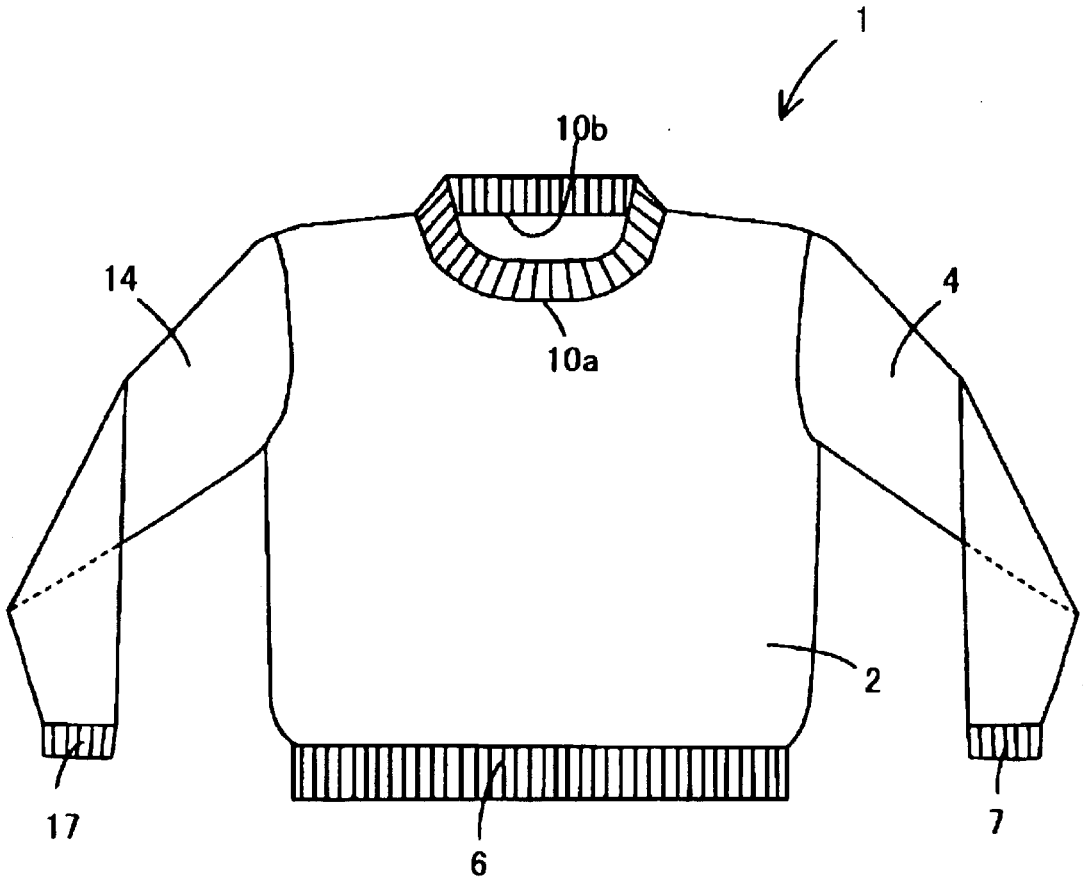
FIG. 1 shows a round-necked sweater knitted as knitwear.
Figure 2:
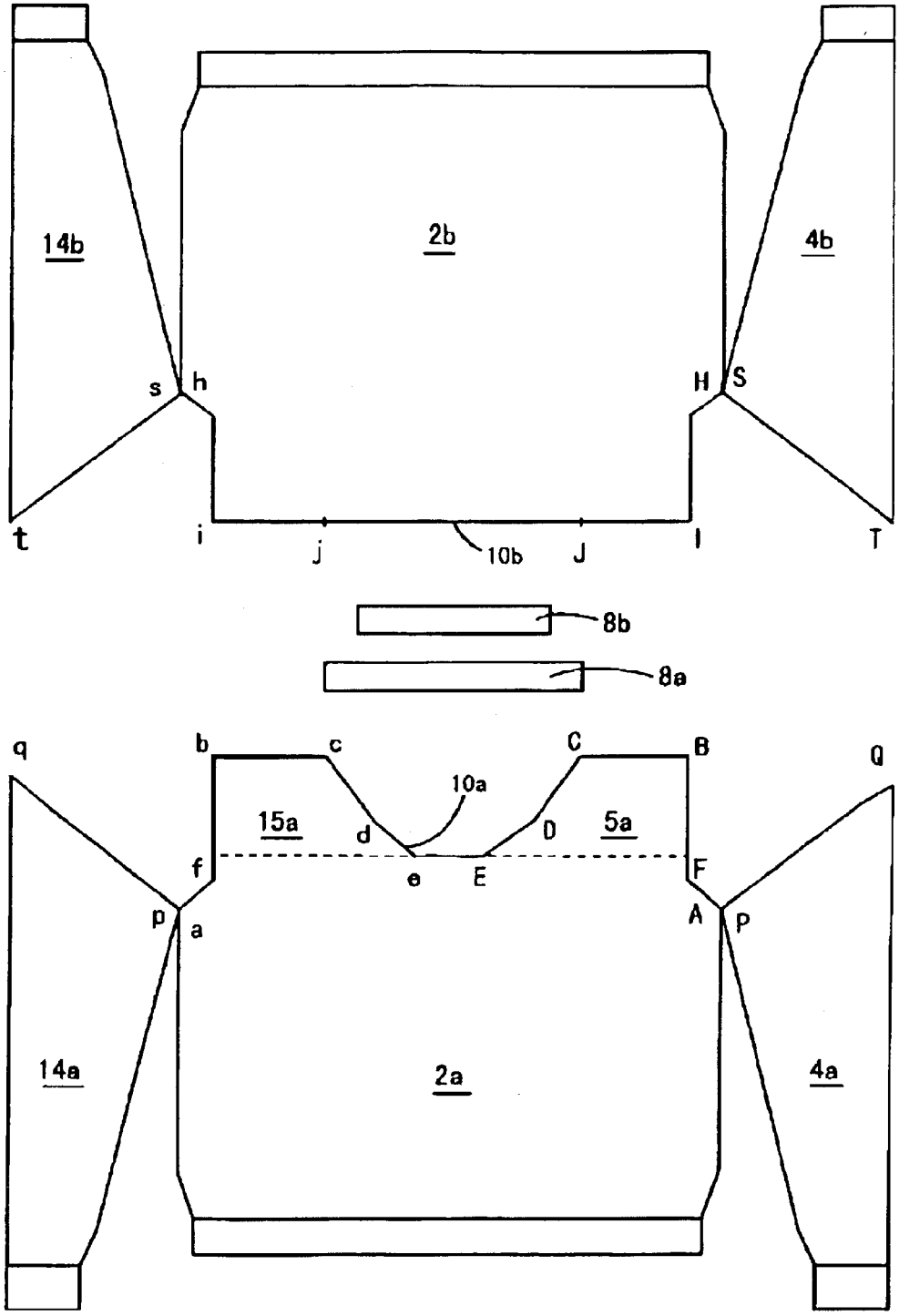
FIG. 2 shows parts of the sweater that are to be knitted on a flat knitting machine.
Figure 3:
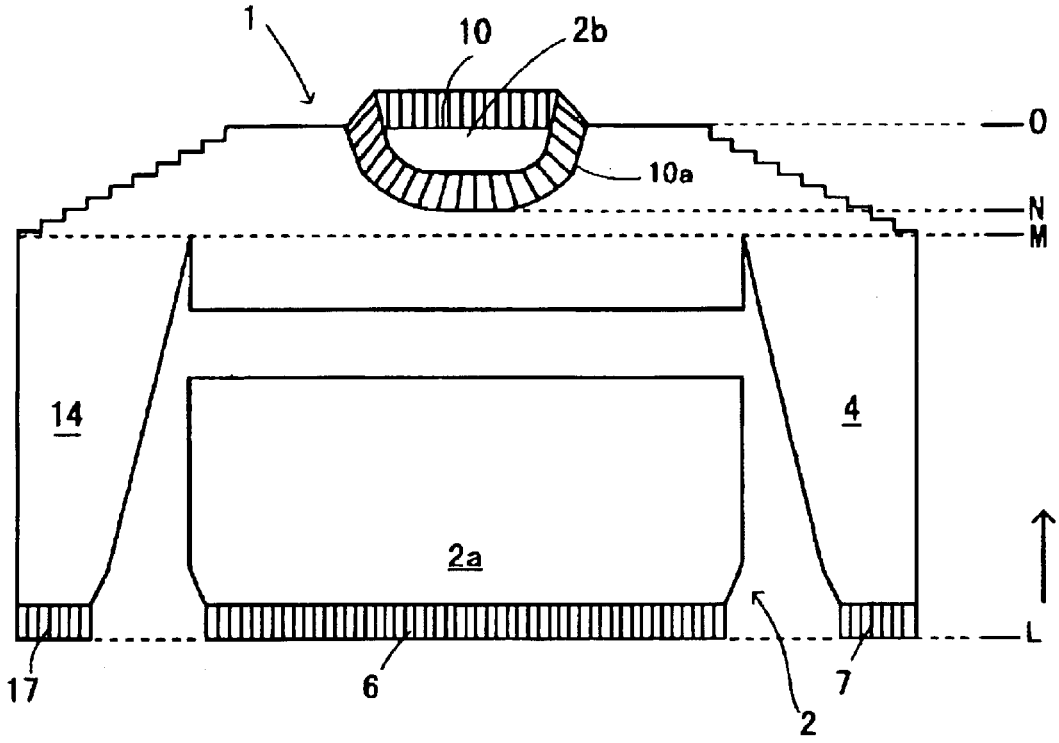
FIG. 3 shows an outline of the knitting of the sweater in the respective steps.
Figure 4:
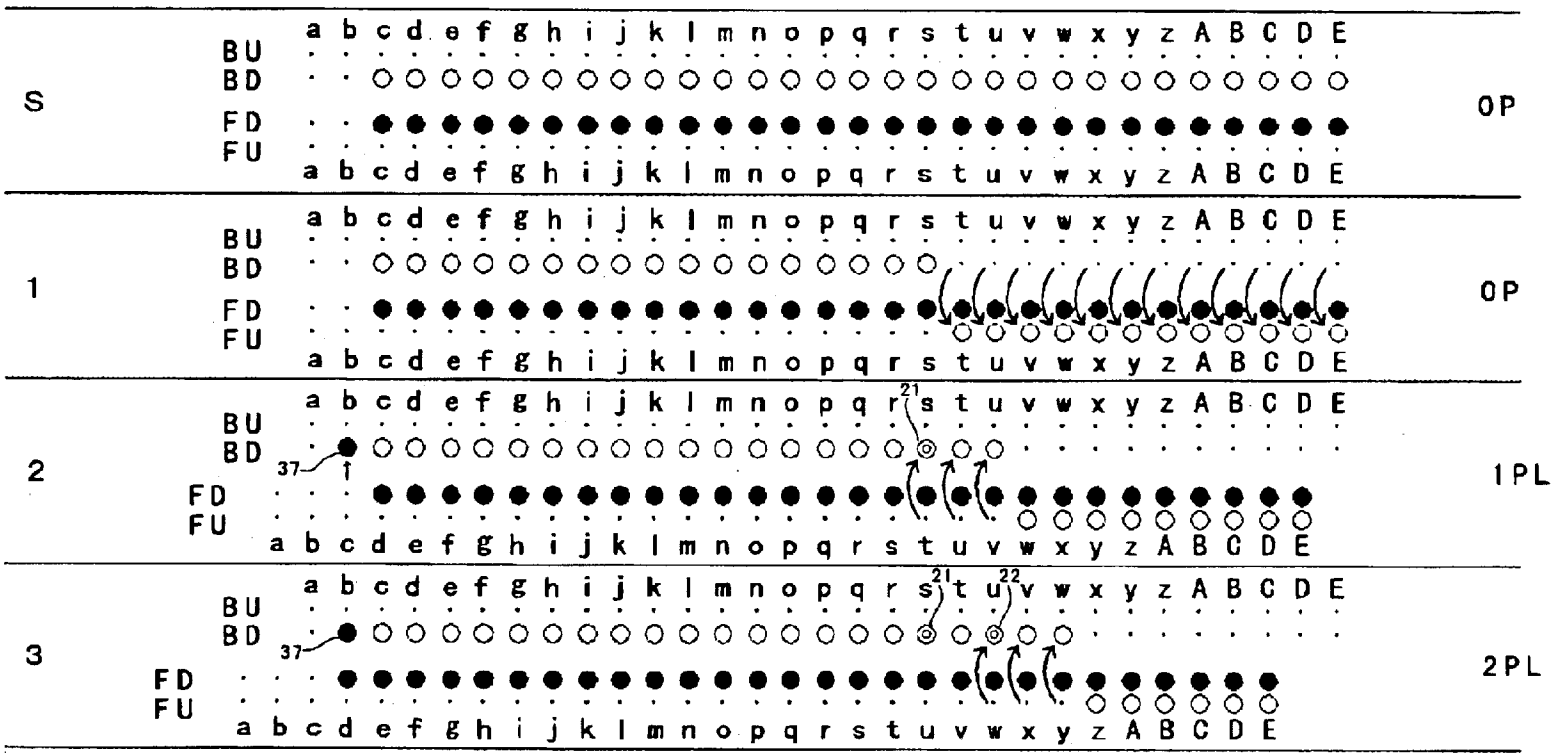
FIG. 4 shows the knitting steps S-3 for reducing the number of wale of the back neckline.
Figure 5:
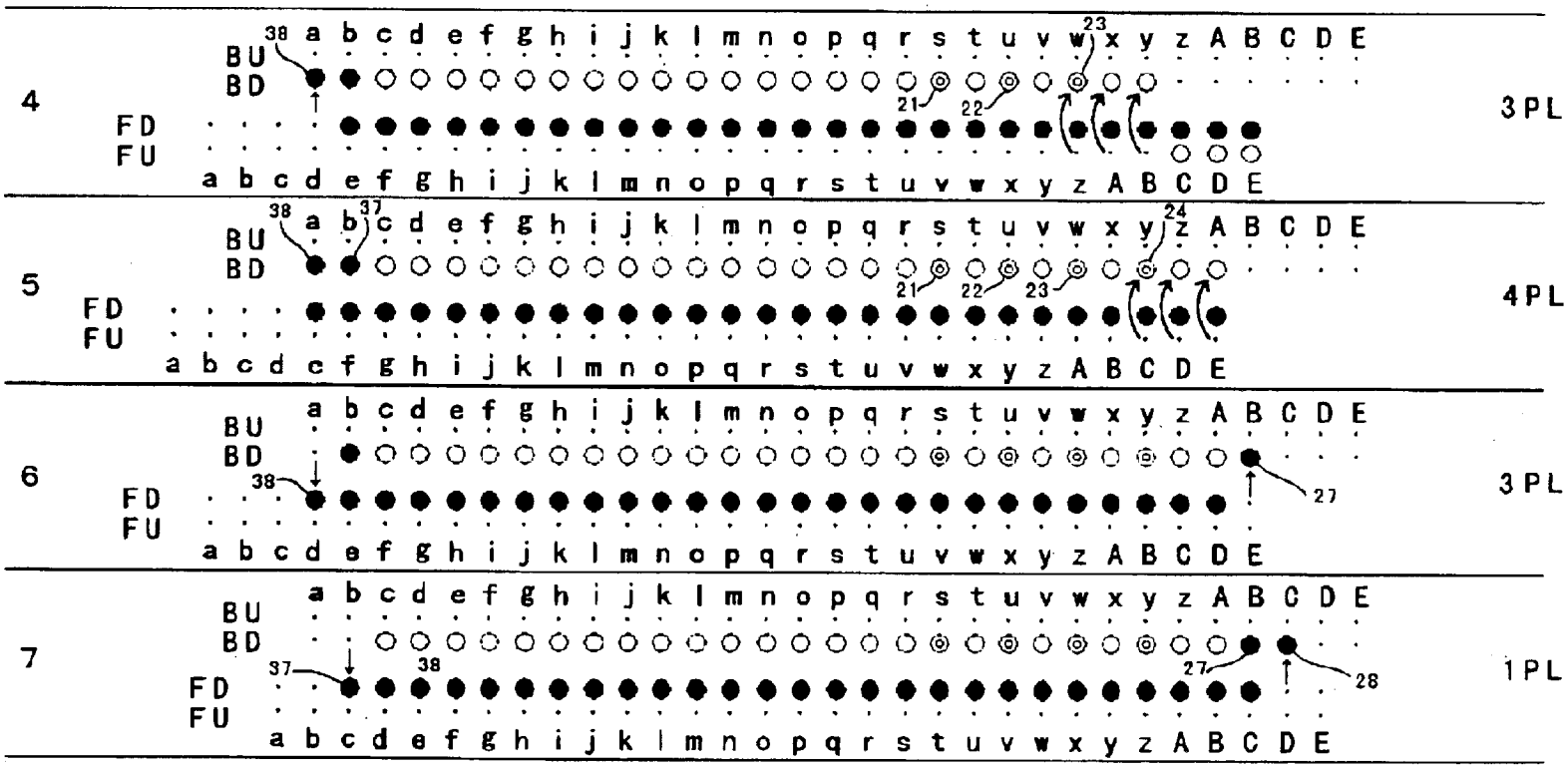
FIG. 5 shows the knitting steps 4–7 for reducing the number of wale of the back neckline.
Figure 6:
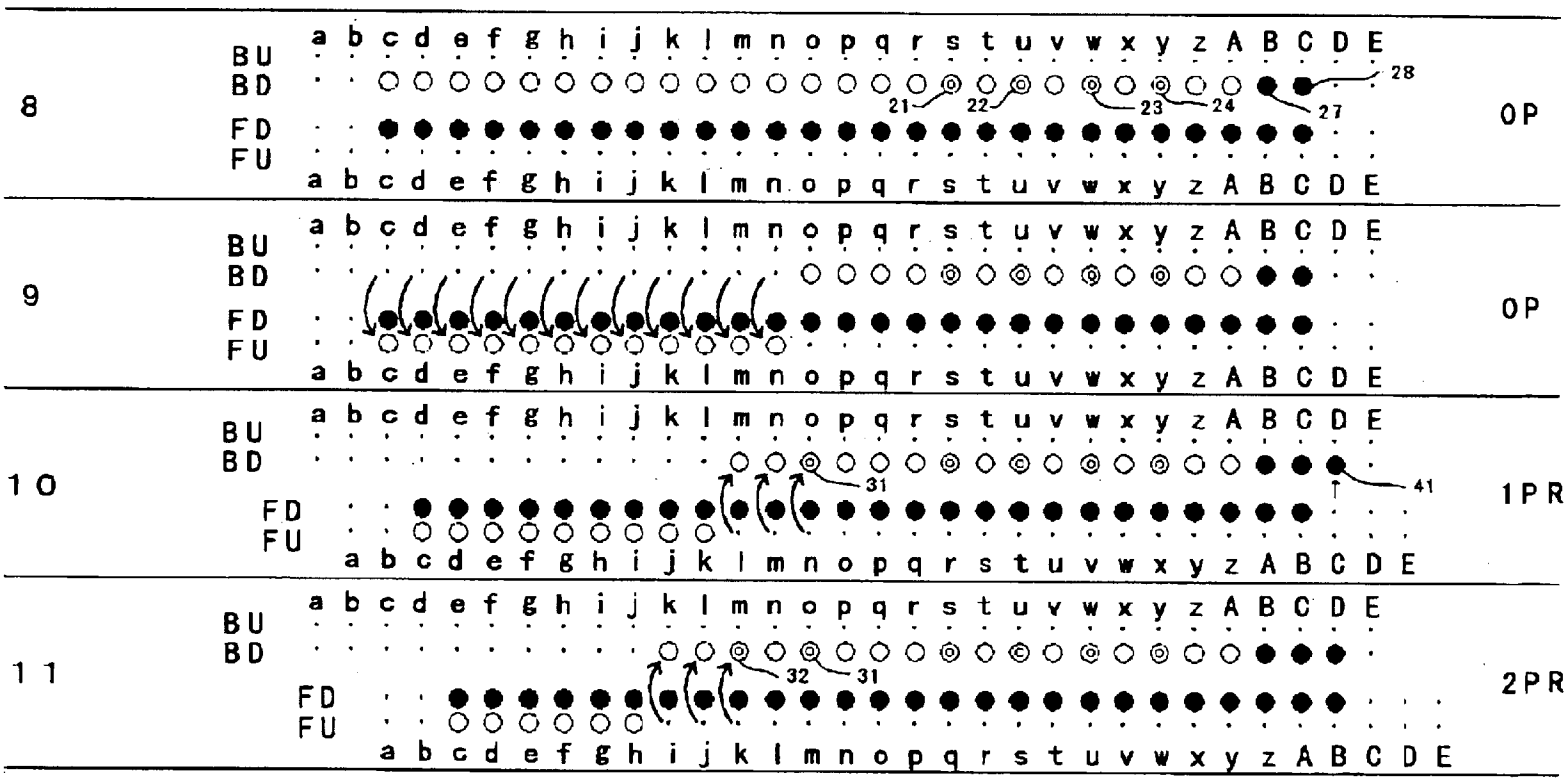
FIG. 6 shows the knitting steps 8–11 for reducing the number of wale of the back neckline.
Figure 7:
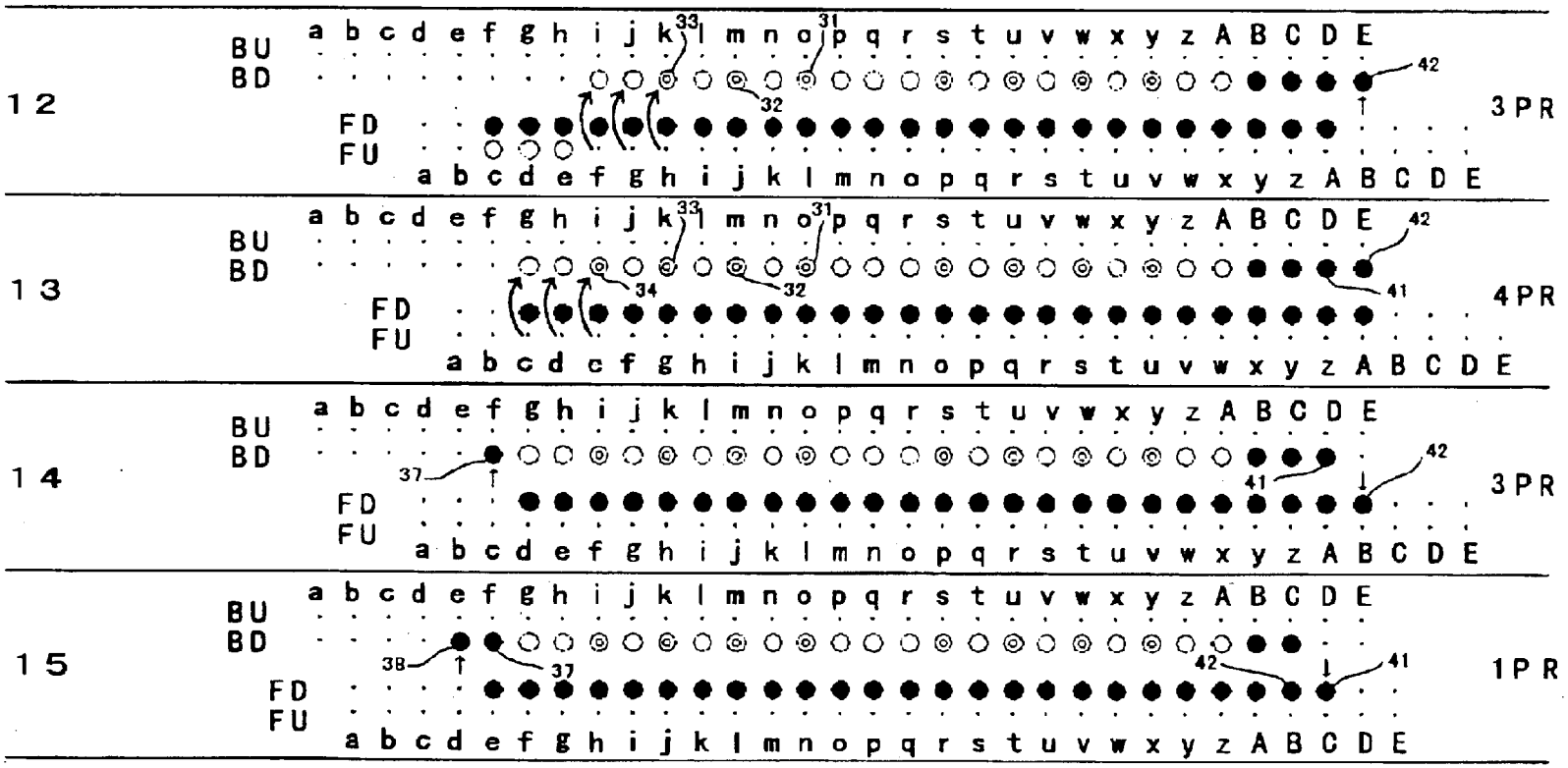
FIG. 7 shows the knitting steps 12–15 for reducing the number of wale of the back neckline.
Figure 8:
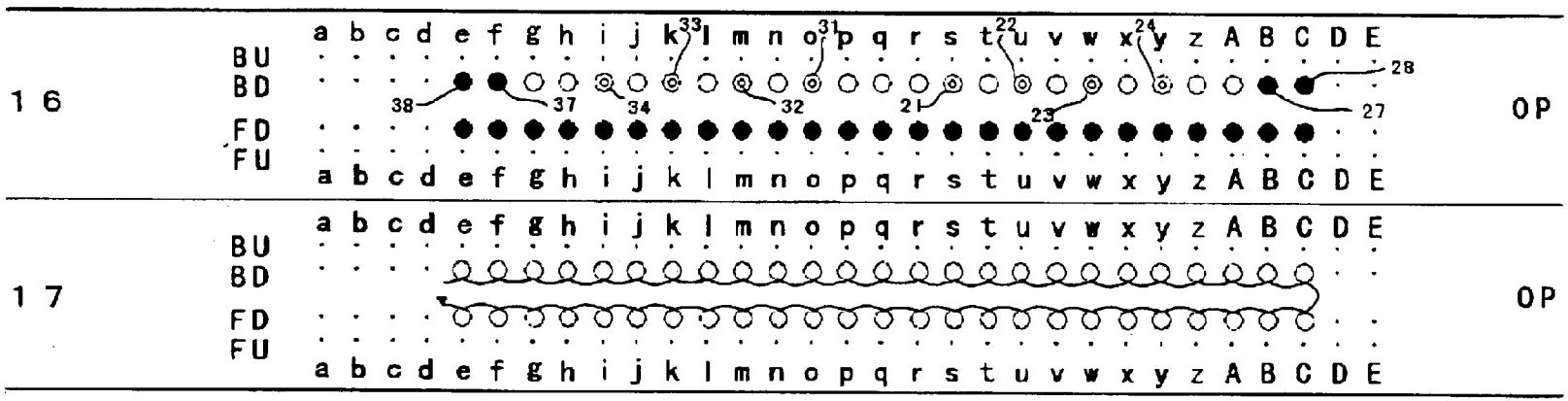
FIG. 8 shows the knitting steps 16–17 for reducing the number of wale of the back neckline.
Figure 9:
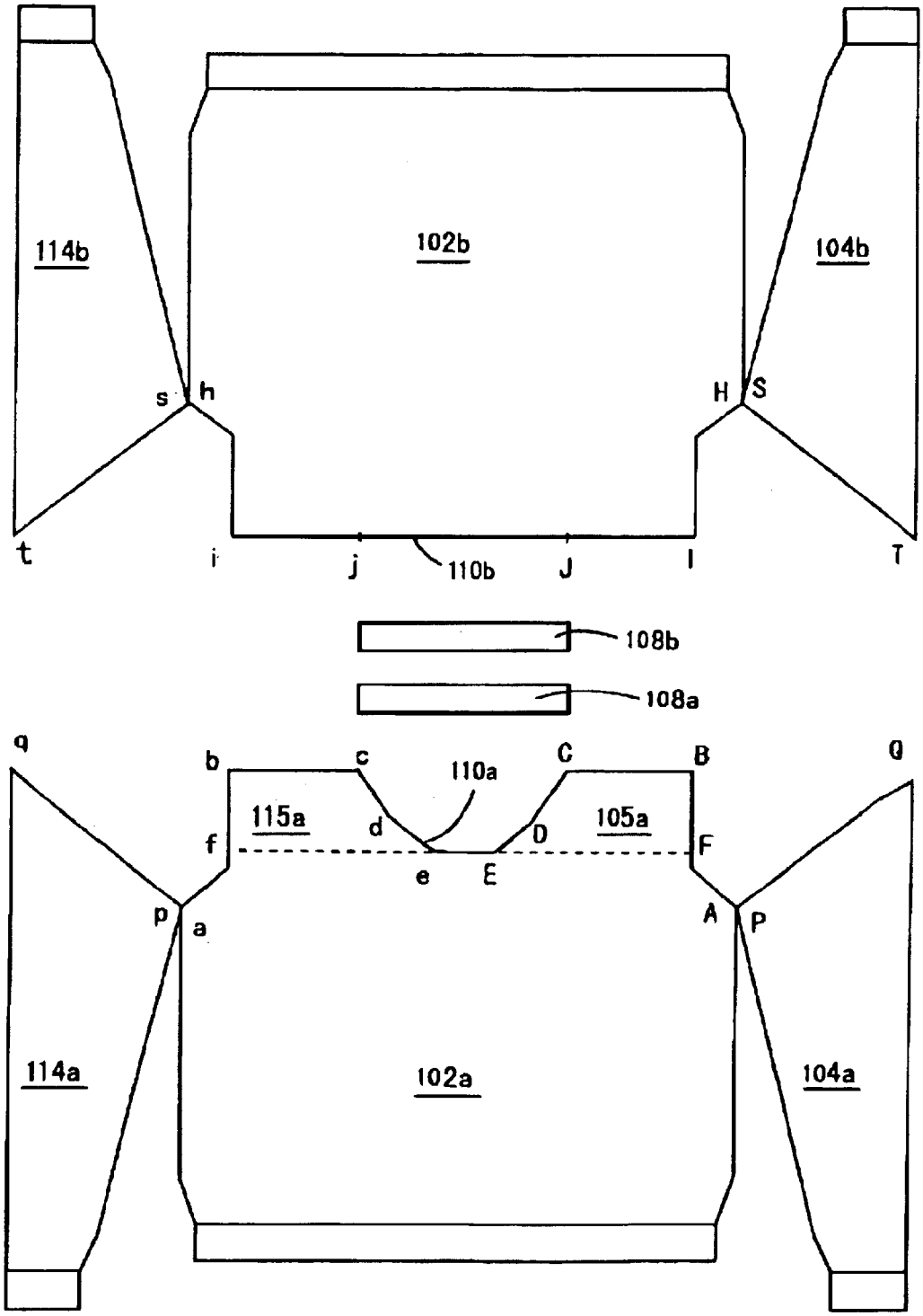
FIG. 9 shows parts of the sweater that are to be knitted on the flat knitting machine in the prior art.

FIG. 1 shows a sweater 1 knitted as knitwear in this embodiment. The sweater 1 is a round-neck sweater having set-in sleeves and a U-shaped (circular-arc shaped) neckline. FIG. 2 shows a pattern paper (stitch alignment) of bodies and sleeves of the sweater 1. Illustrated above is the pattern of a back body 2*b* and back sleeve parts 4*b*, 14*b* which will appear at the back side when wearing the sweater. Illustrated below is the pattern of a front body 2*a* and front sleeve parts 4*a*, 14*a* which will appear at the front side when wearing the sweater. FIG. 3 shows an outline of the knitting of the sweater 1 in the respective steps. The knitting proceeds in the direction indicated by an arrow, beginning at L. For convenience of explanation, the sweater is designed in the form of an unpatterned plain knit, though it may have another structure pattern such as jacquard or rib.

In the sweater 1, the front body 2*a* and the front sleeve parts 4*a*, 14*a* are joined together at their underarms A, a and P, p, and the back body 2*b* and the back sleeve parts 4*b*, 14*b* are joined together at their underarms H, h and S, s. The line A-F-B of the front body 2*a* and the line P-Q of the sleeve 4*a* are joined together, and the line a-f-b of the front body 2*a* and the line p-q of the sleeve 14*a* are joined together. Likewise, the line H-I of the back body 2*b* and the line S-T of the sleeve 4*b* are joined together, and the line h-i of the back body 2*b* and the line s-t of the sleeve 14*b* are joined together. The front body 2*a* is different from the back body 2*b* in the shape subsequent to the points F, f of the neckline 10*a* and is knitted to be forked into the right front body 15*a* and the left front body 5*b*. The line C-D-E-e-d-c is the front neckline 10*a*. As the front drop is formed between the points C-c of the front neckline 10*a*, the front neckline 10*a* between the points C-c has a sufficient number of wale. As a result of this, the shoulder is previously formed to have a larger width, so as not to put an influence on the dimensions of B-C, b-c, I-J and i-j. Although the number of wale between the points J-j of the back body is substantially equal to the number of wale between the points C-c of the front body, the number of wale therebetween of the back body is previously decreased as mentioned later, before a back collar 8*b* is knitted, so that the back collar 8*b* can have a width narrower than the front collar 8*a*. As illustrated in the step L of FIG. 3, the knitting of rib portions 6, 7, 17 of a tubular body is started by using yarn feeders (not shown) prepared for the body 2 and the sleeves 4, 14, respectively. From this step, the body 2 and the sleeves 4, 14 are each knitted from the rib portions up to the underarms in the form of a tubular fabric. From the step M to the step N, while the front body 2*a*, the back body 2*b*, the left sleeve 4 and the right sleeve 14 are knitted in a single tubular body, the body 2 and the sleeves 4, 14 are joined together in each course knitting. From the step N, in addition to the knitting in the steps M-N, the front body 2*a* is knitted to be forked into the left front body 5*a* and the right front body 15*a* and, in parallel with this knitting, the body and the sleeves are knitted up to the shoulder while they are joined together along the lines A-F-B, P-Q, a-f-b and p-q. During these steps, the so-called flechage knitting that the stitches around the line C-D-E-e-d-b of the front neckline 10*a* are sequentially put into operative states is repeatedly performed in the right and left front bodies 5*a*, 15*a*, whereby a circular-arc cut is formed at the front neckline 10*a*. When the knitting up to the shoulder is ended, a sufficient number of wale for forming the front drop is formed between the right front body and the left front body. Sequentially, the lines B-C and b-c of the front body 2*a* and the lines I-J and i-j of the back body 2*b* are joined together and are bound off at the shoulder in a known bind-off method. At the time when the bind-off process of the shoulder is ended, the stitches between the points C-c of the front neckline 10*a* are retained on the needles of the front needle bed and the stitches between the points J-j of the back body 2*b* are retained on the needles of the back needle bed.

The front neckline 10*a* has a sufficient number of wale for forming the front drop, and the back neckline 10*b* has substantially the same number of wale, but no drop of the neckline is formed in the back body 2*b*. If the collar 8 is knitted in continuity with the neckline in this condition by feeding yarns to the needles retaining the stitches of the neckline thereon, then an ill-shaped, flaccid collar will be formed. For avoidance of this, the following knitting is inserted before the knitting of the collar 8 is started, which is one of the key features of the present invention. In detail, the number of wale of the back neckline 10*b* is previously decreased before the knitting of the collar 8 is started and the stitches at the side ends of the front neckline 10*a* are fed to the back neckline 10*b* having a decreased number of wale.

FIGS. 4–8 illustrate the knitting steps for decreasing the number of wale of the back neckline lob. The step S shows the stitches retained on the needles of the needle beds when the bind-off process of the shoulder is ended. The stitches of the front neckline 10*a* are retained on the needles c-E of the front lower needle bed, and the stitches of the back neckline 10*b* are retained on the needles c-E of the back lower needle bed. In the drawings, the stitches of the front neckline 10*a* are depicted by black circles and the stitches of the back neckline 10*b* are depicted by white circles. For convenience of explanation, a fewer number of knitting members including needles than the actual number of knitting members including needles is illustrated. In this embodiment, the knitting for decreasing the number of wale of the back neckline 10*b* is started at the right side, first, and, then, goes on to the left side. The number of wale is decreased by overlapping the adjacent stitches in the back neckline 10*b* with each other, and four wale in each side of the back neckline 10*b*, or eight wale in total in both sides thereof, are decreased. The decrease of the number of wale causes the difference in the number of wale between the FD retaining the front neckline 10*a* and the BD retaining the back neckline 10*b*. To minimize this difference, the knitting wherein the stitches of the front neckline 10*a* retained on the needles c, d, D, E are sequentially fed to the BD is concurrently performed in the course of the knitting for decreasing the number of wale of the back neckline.

Reference is made of the steps 1–7, first. These steps show the process for decreasing the number of wale at the right side of the back neckline lob. In the step 1, the stitches of the back neckline 10*b* retained on the needles t-E of the BD are transferred to the FU. In the step 2, after the FD and the FU are racked leftwards one stitch, the stitches retained on the needles t, u, v are transferred to the opposed needles s, t, u of the BD, whereby a double stitch 21 is formed at the needles. In the steps 3, 4 and 5, after the FD and the FU are racked leftwards from the position of the step 1 two further stitches, three further stitches and four further stitches, respectively, the stitches of the back neckline 10*b* are transferred to the opposed needles as illustrated, whereby double stitches 22, 23, 24 are formed on the needles u, w, y, respectively. As a result of this, four wale of the back neckline 10*b* are decreased. During this knitting, the stitches 37, 38 of the front neckline 10*a* retained on the needles c, d of the FD are transferred to the needles b, a of the BD in the steps 2 and 4. This knitting process is taken to prevent occurrence of yarn breakage when the front and back needle beds are relatively racked laterally to a large extent and large load is put on the stitches at the side ends of the front neckline 10*a* and the back neckline 10*b*. The steps 6 and 7 show the knitting wherein the stitches 27, 28 of the front neckline 10*a* retained on the needles E, D of the FD are fed to the BD, to minimize the difference in number of wale between the BD retaining the back neckline 10*b* from which four wale was taken and the FD retaining the front neckline 10*a*, so as to prevent the stitches from being spaced apart from each other to a large extent between the front and back needle beds. In the steps 6 and 7, the FD and the FU are racked leftwards three stitches and one stitch, respectively. In parallel with this, the stitches 37, 38 at the left side end of the front neckline 10*a* as were transferred to the BD in the previous steps 2 and 4 are transferred back to the FD. The step 8 shows the stitches retained on the needle beds when the decrease of the number of wale at the right side of the back neckline 10*b* is completed. It will be seen from the illustration that in the step 8, double stitches 21–24 are formed at the right side of the back neckline 10*b* retained on the alternate needles B, U, w, y and also the stitches 27, 28 at the right side end of the front neckline 10*a* are transferred to the BD.

Next, in the steps 9–16, the process for decreasing the number of wale at the left side of the back neckline 10*b* is taken in the same manner as in the steps mentioned above. In the step. 9, the stitches retained on the needles c-n of the BD are transferred to the FU. In the step 10, after the FD and the FU are racked rightwards one stitch, the stitches retained on the needles 1, m, n are transferred to the corresponding needles m, n, o of the BD, whereby a double stitch 31 is formed at the needle o. In the steps 11, 12 and 13, after the FD and the FU are racked rightwards two stitches, three stitches and four stitches, respectively, the stitches of the back neckline are transferred to the opposed needles as illustrated, whereby double stitches 32, 33, 34 are formed on the needles m, k, i, respectively. As a result of this, four wale at the left side of the back neckline 10*b* are decreased. The knitting of the steps 10 and 12 correspond to the knitting of the previous steps 2 and 4. In the knitting of the steps 10 and 12, the stitches 41, 42 at the side end of the front neckline 10*a* retained on the needles C, D of the FD are transferred to the needles of the BD, to prevent occurrence of yarn breakage. The knitting of the steps 14 and 15 correspond to the knitting of the previous steps 6 and 7. In the steps 14 and 15, the stitches 37, 38 of the front neckline are fed to the BD, to minimize the difference in number of wale between the BD retaining the back neckline 10*b* and the FD retaining the front neckline 10*a*. In parallel with this, the stitches 41, 42 at the right side end of the front neckline 10*a* as were transferred to the BD in the previous steps 10 and 12 are transferred back to the FD.

The step 16 shows the stitches retained on the needle beds when the knitting for decreasing the number of wale of the back neckline 10*b* is completed. In the step 16, eight double stitches are formed at the left side of the back neckline 10*b* retained on the alternate needles i, k, m, o and at the right side of the back neckline 10*b* retained on the alternate needles s, U, w, y and also two stitches at each side end of the front neckline 10*a* are fed to the BD. In the step 17, the collar 8 is knitted. The collar 8 is formed in the knitting wherein the yarn is cyclically fed to the needles e-C of the BD and in turn to the needles C-e of the FD. This knitting is repeated to obtain a circularly knitted collar 8 having a desired length.

In this method, the number of wale more than the number of wale actually required for knitting the collar is previously reserved on the back neckline 10*b* confronting the front neckline 10*a* which is formed to have a sufficient number of wale when the bind-off process of the shoulder is ended. Then, adjacent stitches in this back neckline 10*b* are overlapped with each other to thereby decrease the number of wale of the back neckline 10*b* and reduce the width of the same to a certain extent. Thereafter, the stitches at the side ends of the front neckline 10*a* formed to have a sufficient number of wale are sequentially fed to the back neckline 10*b* having the reduced width retained on back needle bed in such a manner that the back neckline can be sandwiched between the side ends of the front neckline, whereby the peripheral length of the neckline 10 is reduced. Sequentially, the collar 8 is knitted. As a result of this knitting, at the time when the collar 8 is knitted, the points C and c of the front neckline 10*a* come closer to each other. As a result of this, the front neckline 10*a* can be prevented from being stretched transversely, thus producing knitwear with the front drop having a sufficient depth. In addition, since this knitting method does not include the step that the right and left front bodies confronting each other across the neckline are shifted outside while the stitches are transferred, differently from the knitting method of the previously cited prior art, the number of times of the flechage knitting can be increased, thus enabling the front drop to have an increased depth. Also, since the number of wale of the back neckline is reduced by forming the double stitches, the effect of stay stitching of the neckline can be provided.

The knitting method of the present invention is effective for knitting a collar having a relatively short length; for the knitting way of giving a rich body structure to the collar with respect to the direction of the collar width, such as a ribbed structure and a 2×2 rib structure; and for knitting a rather thick collar by using a plating yarn, and can afford a beautiful silhouette.

In place of the four-bed flat knitting machine, the two-bed flat knitting machine can be used for the knitting method. When the two-bed flat knitting machine is used, for example, odd needles on the needle beds are used for the front body; even needles are used for the back body; and alternate needles on the front and back needle beds are used for the seamless knit. When the front body is knitted, the back body is associated with the back needle bed. On the other hand, when the back body is knitted, the front body is associated with the front needle bed. The respective fabrics are knitted, with the front and back bodies overlapping each other in front and back. As a result of this, the empty needles used for transference of stitch can always be reserved for the respective knitted fabrics on the opposed needle bed. Using those empty needles enables the knitting of the structure pattern, such as links, garter and rib, in which front stitches and back stitches are mixed, and also enables the stitches to be shifted laterally.

When the stitch loop holding technique disclosed by Japanese Laid-open open (Unexamined) Patent Publication No. Hei 11(1999)-43849, which is called "holding technique", is used, even the two-bed flat knitting machine can knit the knitwear seamlessly with all needles, as in the four-bed flat knitting machine, without any need for previous reservation of the empty needle for the transference of stitch and without any limitation of using the alternate needles. However, in this case, the flat knitting machine is required to have compound needles which are called "slide needle".

While in the illustrated embodiment, the number of wale of the back neckline is decreased by forming double stitches at alternate needles at the right and left side centering on the needle q, this is not limitative. The way of decreasing the number of wale of the back neckline can properly be varied or modified depending on the number of wale of the back neckline to be formed and the number of wale to be decreased. As the number of wale to be decreased increases, the number of stitches of the front neckline to be fed to the back needle bed increases.

What is claimed is:

1. A method of knitting a collar of knitwear comprising a front body and a back body by using a flat knitting machine comprising at least a pair of first and second needle beds, at least either of which can be racked laterally to transfer stitches between the needles beds, wherein the knitwear is knitted in the condition that the front body is associated with the first needle bed and the back body is associated with the second needle bed, so that the front body and the back body are joined together at both knitting-widthwise ends to be knitted into a tubular body, and wherein the knitwear is knitted from its rib hem toward its shoulder, in the course of which from a front neckline forming starting point, the front body is forked into a right front body and a left front body and also the front body and the back body are knitted up to the shoulder while a flechage knitting that stitches around the neckline are sequentially removed from the knitting so as to be put into inoperative states is repeated a predetermined number of times to form the neckline in a circular-arc cut form, first, and, then, are joined together at the shoulder, followed by forming of a collar around the neckline, the method comprising the following steps:

a) that when the neckline of the front body is formed, a sufficient number of wale for forming a front drop having a sufficient depth is introduced in the front body, to form the neckline of the front body;

b) that after the neckline of the front body is formed, the front body and the back body are joined together at the shoulder in such a relation that a back neckline of the back body confronts the front neckline of the front body and has substantially the same number of wale as the number of wale of the front neckline;

c) that the number of wale of the back neckline is decreased by transferring a stitch of the back neckline and overlapping it with an adjacent stitch in the same back neckline;

d) that during the knitting of the step c), at least one stitch at each side end of the front neckline is fed to the needle bed retraining the back neckline having the decreased number of wale, to minimize difference in the number of wale of the necklines retained between the front and back needle beds; and e) that the collar is knitted in continuity with the knitting of the necklines formed in the steps a) to d).

2. The method of knitting the collar of knitwear by using the flat knitting machine according to claim 1, wherein the knitting for decreasing the number of wale of the back neckline is performed in the order that one of right and left sides of the neckline is subjected to the same knitting, first, and, then, the other of the right and left sides of the neckline is subjected to the same knitting, and wherein the knitting method includes the step that when the number of wale of the back neckline is decreased at the one side of the neckline, the stitch at the side end of the front neckline is temporally fed to the needle bed retaining the back neckline on the other side of the neckline and then the same needle bed is racked, whereby the stitch at the side end of the front neckline and the stitch at the end on the other side of the back neckline are prevented from being spaced apart from each other to a large extent, so as to minimize a load put on those stitches.

3. Seamless knitwear having front and back bodies joined together at both widthwise ends thereof and formed into a tubular body from its rib hem toward its shoulder by using a flat knitting machine, the front body having a right front body and a left front body into which the front body is forked from a front neckline forming starting point, wherein after the front neckline is knitted in a circular-arc cut form by a flechage knitting, the front body and the back body are joined together at the shoulder and then collars are knitted in a circular form in continuity with the front neckline formed in the front body and the back neckline formed in the back body, wherein a back neckline of the back body is formed to have substantially the same number of wale as the number of wale of the confronting front neckline, and wherein the number of wale of the back neckline is decreased by transferring a stitch of the back neckline and overlapping it with an adjacent stitch in the same back neckline.

* * * * *